United States Patent [19]

O'Brien

[11] Patent Number: 4,734,944

[45] Date of Patent: Apr. 5, 1988

[54] SUNTANNING POOL AND METHOD OF TANNING

[76] Inventor: Mary M. O'Brien, 285 S. Pershing, Wichita, Kans. 67218

[21] Appl. No.: 889,731

[22] Filed: Jul. 28, 1986

[51] Int. Cl.[4] ..... A47K 3/022

[52] U.S. Cl. ..... 4/589; 4/573; D24/38

[58] Field of Search ..... 4/571–573, 4/589, 590, 496, 546, 578, 584

[56] References Cited

U.S. PATENT DOCUMENTS

| | | | |
|---|---|---|---|
| 2,828,489 | 4/1958 | Baker | 4/589 |
| 3,835,482 | 9/1974 | Tersch | 4/573 |
| 3,969,776 | 7/1976 | Gildea | 4/546 |
| 4,316,294 | 2/1982 | Baldwin | 4/589 X |
| 4,466,141 | 8/1984 | Starkey | 4/488 |
| 4,561,135 | 12/1985 | Adriaansen | 4/572 |

OTHER PUBLICATIONS

Polynesian Pools & Spas, 1984, Sales Brochure AD60.

*Primary Examiner*—Charles E. Phillips
*Attorney, Agent, or Firm*—John Wade Carpenter

[57] ABSTRACT

A unitary suntanning pool comprising a substantially peripheral ridge defining a top opening with a predetermined length and a predetermined width. The unitary suntanning pool additionally comprises a first trough portion, a second trough portion and a divider portion, which separates the first and the second trough portion for contiguously receiving and supporting a human user. A method for a person to suntan in the unitary suntanning pool comprising filling the first and the second trough portions with water until the water innudates a portion of the divider portion such that when the divider portion supports and contiguously receives the body of the person, part of the person's body is immersed in water in order to remain cool while the sun is tanning the body.

6 Claims, 2 Drawing Sheets

FIG. 1
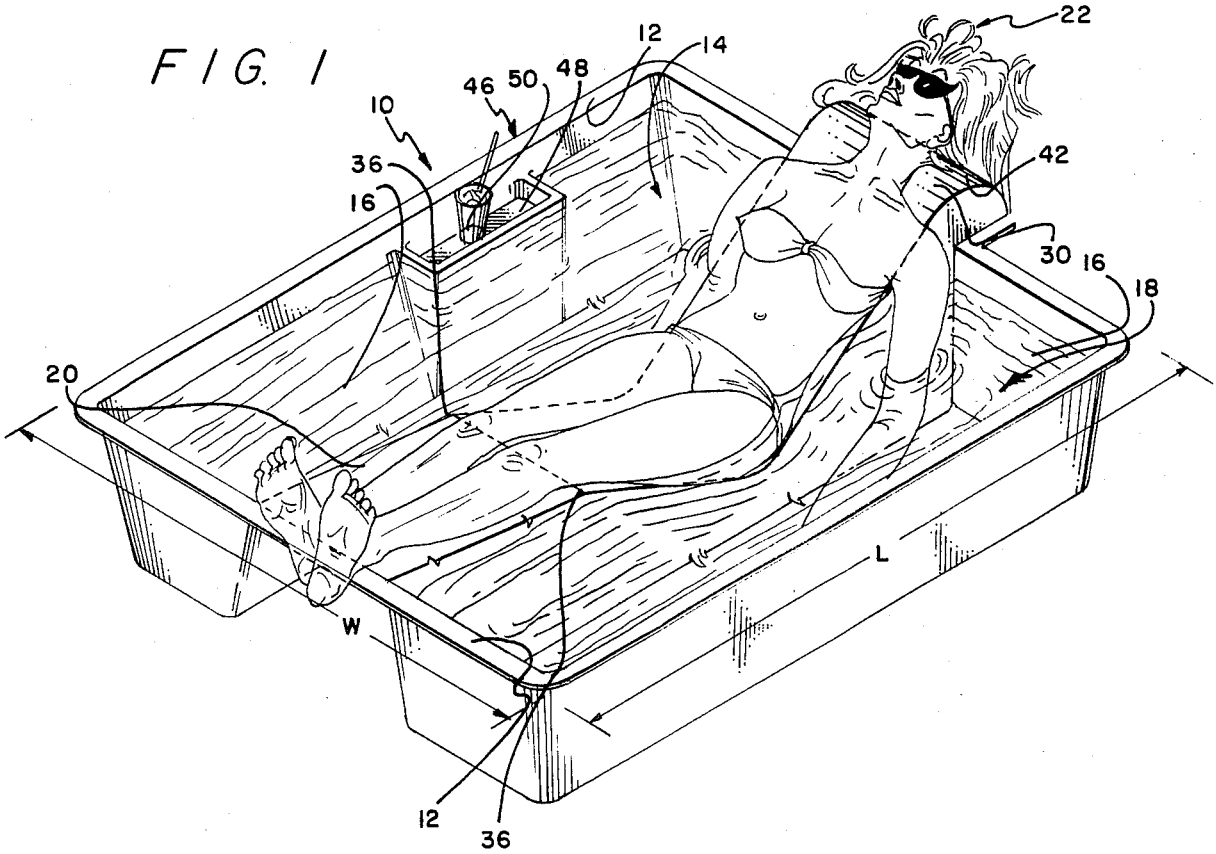
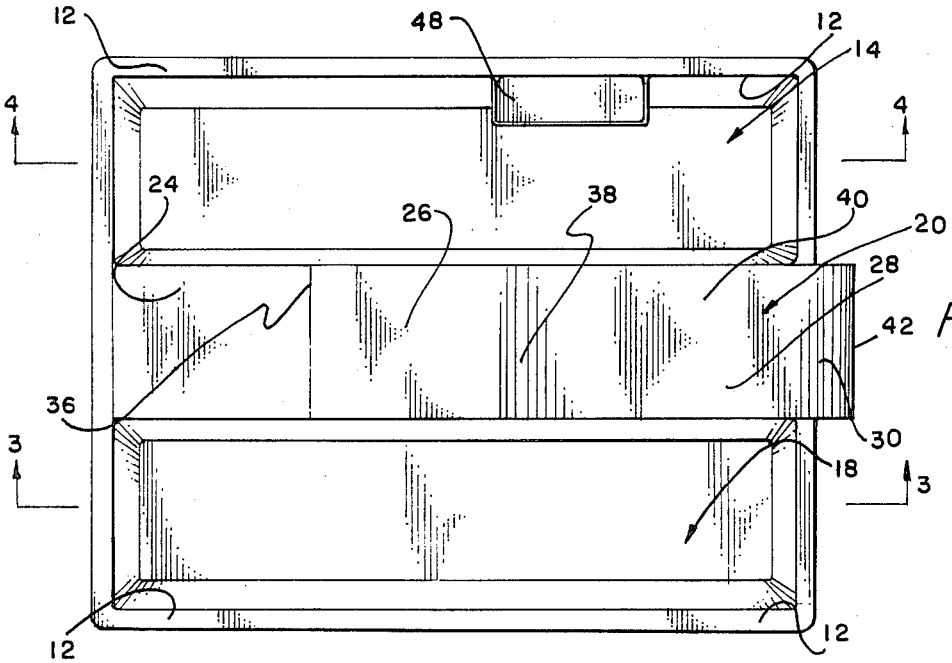
FIG. 2

SUNTANNING POOL AND METHOD OF TANNING

BACKGROUND OF THE INVENTION

1. Field of the Invention.

This invention is related to a suntanning pool. More specifically, this invention provides a suntanning pool and a method for suntanning wherein the human body remains cool while the sun is tanning the human body.

2. Description of the prior art.

U.S. Pat. No. 4,316,294 by Baldwin discloses a bathtub having a bottom configured so that the user may recline and add water to the desired level. U.S. Pat. No. 4,074,370 to Harmony III is also related to a bathtub, but in this case for bedridden patients. U.S. Pat. No. 3,793,653 by Brooks, includes an inclined portion where a person might lay against. U.S. Pat. No. 4,216,552 to Gurolnick teaches an infant bathing device wherein the user is supported in a supine position. None of the foregoing prior art, teaches or suggests the particual suntanning pool, or the method for tanning, of this invention.

SUMMARY OF THE INVENTION

The present invention accomplishes its desired objects by broadly providing a unitary suntanning pool comprising a substantially perpheral ridge means defining a top opening with a predetermined length and a predetermined width. The unitary suntanning pool comprises a first trough portion generally configured for receiving and retaining water. The first trough portion has a first trough length approximating the predetermined length and a first trough width spaning approximately one-third of the predetermined width of the top opening. The unitary suntanning pool additionally comprises a second trough portion which is also generally configured for receiving and retaining water. The second trough portion has a second trough length approximating the predetermined length and a second trough width spaning approximately one-third of the predetermined width of the top opening.

A divider portion is between the first and second trough portion for contiguously receiving and supporting a human user. The divider portion has a divider length spaning the entire predetermined length of the top opening from one part of the predetermined width of the peripheral ridge to an opposed part of the predetermined width of the peripheral ridge. The divider portion has a divider width spaning approximately one-third of the predetermined width of the top opening. The divider portion comprises seriatim a generally gradually sloping lower rest area, an intermediate rest area, a reclining rest area, and a head rest area. The sloping lower rest area spans horizontally on the order of about one-third the horizontal length of the predetermined length of the top opening for contiguously receiving and supporting the calves and feet of any sized user in an elevated posture. The intermediate rest area is defined by a sloping intermediate surface smoothly merging with the lower rest area surface at a more acute angle with respect to a horizontal plane than the lower rest area slopes with a horizontal plane and spans on the order of about one-third the horizontal length of the predetermined length of the top opening for contiguously receiving and supporting the lower mid-section of any sized user. The reclining rest area is defined by a reclining surface smoothly merging with the sloping intermediate surface and sloping at a more acute angle with respect to a horizontal plane than the sloping intermediate surface. The reclining surface contiguously receives and supports that back and shoulders of any sized user and terminates into the head rest area which interrupts the peripheral ridge means and extends upwardly and outwardly relative to the peripheral ridge means. The head rest area has a terminal end defining an arc with a transversely extending recess formed in the inner surface thereof.

The present invention also accomplishes its desired objects by broadly providing a method for a person to suntan in a unitary suntanning pool having a substantial peripheral ridge means defining a top opening with a predertermined length and a predetermined width and having a divider portion including a gradually sloping lower rest area and separating a first trough portion and a second trough portion, both which span the entire predetermined length of the top opening and wherein the divider portion, the first trough portion and the second trough portion each have a width spaning approximately one-third of the predetermined width of the top opening, the method comprises the steps of:

(a) filling the first and the second trough portions with a liquid means until the liquid means inundates a lower portion on an intermediate rest area of the divider portion defined by a sloping intermediate surface smoothly merging with a gradually sloping lower rest area surface at a more acute angle with respect to a horizontal plane, then the lower rest surface slopes with a horizontal plane and until the liquid means inundates a lower portion of a reclining rest area of the divider portion defined by a reclining surface smoothly merging with a sloping intermediate surface and sloping at a more acute angle with respect to a horizontal plane than the sloping intermediate surface;

(b) supporting and contiguously receiving the person's calves and feet on the lower rest area, the person's lower mid-section including thighs on and between the intermediate surface and the lower portion of the reclining surface such that the person's lower mid-section including thighs is partially covered with the liquid means, and the person's upper mid-section, back and shoulders on the reclining surface;

(c) resting the person's head on a head rest area which interrupts the peripheral ridge and extends upwardly and outwardly relative to the peripheral ridge;

(d) immersing the person's right hand and arm into the liquid means within the first trough portion in order to keep the same cool while being suntanned; and (e) immersing the person's left hand and arm into the liquid means within the second trough portion in order to keep the same cool while being suntanned.

Therefore, it is the object of the present invention, to provide a suntanning pool.

It is another object of this invention to provide a method for a person to suntan utilizing the suntanning pool.

These, together with the various ancillary objects and features which will become apparent to those skilled in the art as the following description proceeds, are attained by this improved suntanning pool and method, a preferred embodiment being shown with reference to the accompanying drawings, by way of example only, wherein:

DESCRIPTION OF DRAWINGS

FIG. 1 is a perspective view of the suntanning pool of this invention with a female user being supported by the divider portion;

FIG. 2 is top plane view of the suntanning pool of this invention;

DETAILED DESCRIPTION OF THE INVENTION

Figure 3:
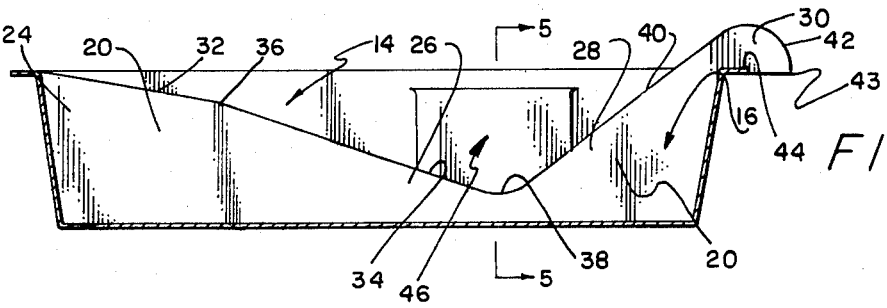
FIG. 3 is a vertical sectional view taken in direction of the arrows and along the plane of line 3—3 in FIG. 2.
Figure 4:
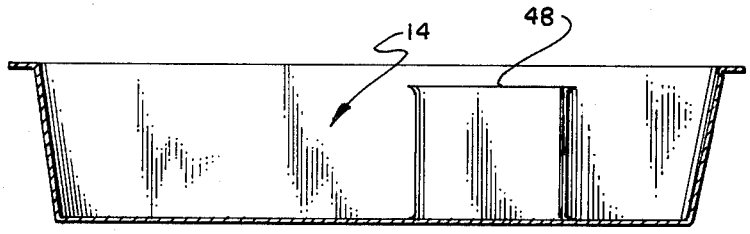
FIG. 4 is a vertical sectional view taken in direction of the arrow and along the plane of line 4—4 in FIG. 2.
Figure 5:
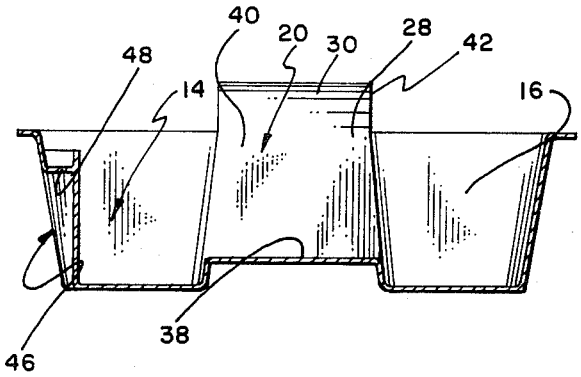
FIG. 5 is a vertical sectional view taken in direction of the arrows and along the plane of line 5—5 in FIG. 3.

Referring in detail now to the drawings, wherein similar parts of the invention are identified by like reference numerals, there is seen the suntanning pool of the invention, generally illustrated as 10, having a substantially peripheral ridge 12 the majority of all points of which define a plane and a top opening with a predetermined length, L, and a predetermined width, W.

The pool 10 has a first trough portion, generally illustrated as 14, which is configured generally for receiving and retaining water 16, or the like. The first trough portion 14 has a length that is approximately equal to or identical with the predetermined length L and a width spanning approximately one-third the predetermined width W.

The pool 10 has a second trough portion, generally illustrated as 18, which is also configured generally for receiving and retaining water 16. The second trough 16 has a length that also approximates the predetermined length L and a width that also spans approximately one-third the predetermined width W.

A divider portion, generally illustrated as 20, is situated between the first trough portion 14 and the second trough portion 18 for contiguously receiving and supporting a human user, generally illustrated as 22 in FIG. 1. The divider portion 20 has a divider length that spans the entire horizontal predetermined length L of the top opening from one part of the predetermined width W of the peripheral ridge 12 to an opposed part of the predetermined width W of the peripheral ridge 12 as illustrated in FIGS. 1, 2, and 3. The divider portion 20 has a width that spans approximately one-third of the predetermined width W of the top opening and the peripheral ridge 12.

Figure 6:
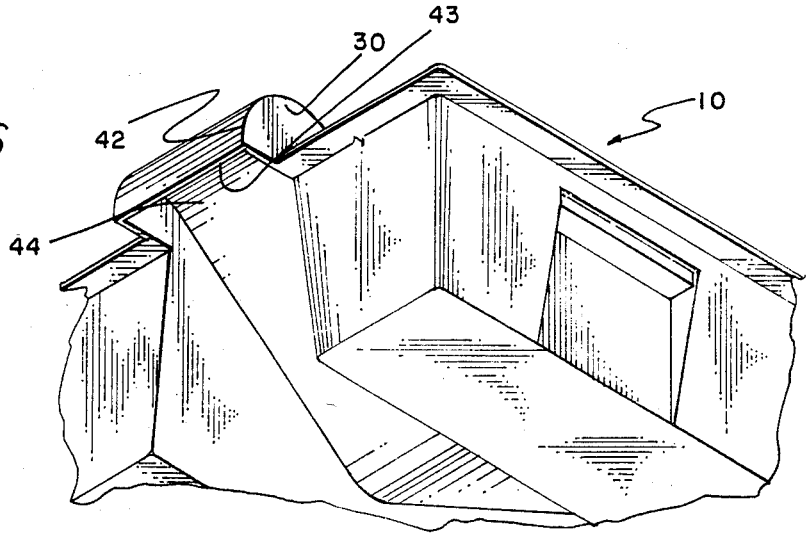
FIG. 6 is a partial perspective view of the back and the underside of the suntanning pool of this invention.

The divider portion 20 comprises serially a gradually sloping lower rest area 24, an intermediate rest area 26, a reclining rest area 28, and a head rest area 30. The gradually sloping lower rest area 24 with a sloping lower surface 32 spans horizontally on the order of about one-third the horizontal length of the predetermined length L of the top opening and the peripheral ridge 12 for contiguously receiving and supporting the calves and feet of the human user 22 (who may be of any size) in an elevated position. As illustrated in FIG. 3, the lower rest area 24 starts gradually sloping from the peripheral ridge 12. The intermediate rest area 26 is defined by a sloping intermediate surface 34 smoothly merging with the lower rest area 24 at 36 at a more acute angle with respect to a horizontal plane than the sloping lower surface 32 slopes with a horizontal plane. The intermediate rest area 26 spans on the order of about one-third the horizontal length of the predetermined length of the top opening for contiguously receiving and supporting the lower mid-section of the human user 22. The reclining rest area is defined by a reclining surface 40 smoothly merging at 38 with the sloping intermediate surface 34 and sloping at a more acute angle with respect to a horizontal plane than the sloping intermediate surface 34. The point of merger at 38 of the intermediate rest area 26 with the reclining rest area 28 is the lowest point of the divider portion 20 with respect to the peripheral ridge 12 and is above the bottom of the first 14 and the second trough portion 16. The reclining surface 40 contiguously receives and supports the back and shoulders of any sized human user 22 and terminates into the head rest area 30 which interrrupts the peripheral ridge 12 and extends upwardly and outwardly relative to the peripheral ridge 12. The head rest area 30 has a terminal end 42 defining an arc with a transversely extending recess 44 formed in the undersurface thereof as illustrated in FIG. 6. As illustrated in FIG. 3, the terminal end 42 terminates in a terminal edge 43. The terminal edge 43 is dipsosed outwardly from the peripheral ridge 12 and lies in a horizontal plane that is common to the horizontal plane of the peripheral ridge 12. The recess 44 is suitable configured to hang or suspend the suntanning pool 10 from a rack or hook in a garage, or like, for storage. A drink holder, generally illustrated as 46, is formed in the side wall of the first trough portion 14. The drink holder 46 comprises a generally rectangular platform 48 for supporting a drink 50. As illustrated in the drawings, the drink holder 48 protrudes outwardly from the side wall into the first trough portion 14.

With continuing reference to the drawings for operation of the invention and the method for a human user 22 to suntan and in unitary suntanning pool 10, the first trough portion 14 and the second trough portion 18 are filled with a liquid means (e.g. water 16) until the liquid means inundates a lower portion of the intermediate rest area 24 of the divider portion 20, and until the liquid means inundates a lower portion of the reclining rest area 28 of the divider portion 20. The person 22 who desires a suntan should position the body such that the lower rest area 24 supports and contiguously receives the calves and feet of the person's body and such that the lower mid-section of the person 22 including thighs is supported and contiguously received on and between the intermediate surface 34 and the lower portion of the reclining surface 40. When the person's body has been positioned as such the lower mid-section of the person 22 including thighs is partially covered with the liquid means 16. The person 22 should also position the body such that the upper mid-section, back and shoulders are on the reclining surface 40. After the person 22 has positioned the body as such, the head of the person 22 is rested on the head rest area 30.

The person 22 may relax the hands and arms along the peripheral ridge 12 in order to obtain the benefit of the sun. When it is desired to cool the body some, the right hand and arm of the person 22 may be immersed into the liquid means 16 within the first trough portion 14 in order to keep the body including the right hand and arm cool while being suntanned. Similarly, the person's left hand and arm may be immursed into the liquid means 16 within the second trough portion 18 in order to keep the body including the left hand and arm cool while being suntanned. The partially immersed mid-section of the body of the user is continually kept cool by the liquid means 16. It should be understood that even though part of the user's body is immersed in the liquid means 16, the immersed parts may still obtain the benefit of the sun's rays which pass through the liquid means 16.

If the user desires to drink liquids to prevent dehydration, the drink 50 may be removed from the drink holder 46, and the person 22 may drink 50 a desired quantity of the drink 50 and replace the drink back into the drink holder 46 and continue the suntanning operation.

Thus, by the practice of this invention, there is provided a suntanning pool 10, and a method for suntanning in the suntanning pool 10 which keeps a person cool while simultaneously being suntanned. The unitary suntanning pool 10 of this invention is easily portable, and may be manufactured or made of fibered glass, reinfiorced plastic, or the like and may be manufactured by vacuum forming procedures over a mold. It should be further noted that the lower portion of the legs of the person 22 may be cooled by removing the calves and feet off of the lower rest area 24 and immersing the left calf and foot and the right calf and foot into the second trough portion 18 and the first trough portion 14, respectively.

While the present invention has been described herein with reference to particular embodiments thereof, a latitude of modifications, various changes and substitutions and intended in the foregoing disclusure, and it will be appreciated that in some features of the invention will be employed without a corresponding use of other features without departing from the scope of the invention as set forth.

We claim:

1. A portable unitary suntanning pool comprising a substantially peripheral ridge means defining a top opening with a predetermined length and a predetermined width;

first trough portion having a bottom and being generally configured for receiving and retaining water and having a first trough length approximating the predetermined length and a first trough width spanning approximately one-third of the predetermined width of the opening;

a second trough portion having a bottom and being also generally configured for receiving and retaining water and having a second trough length approximating the predetermined length and a second trough width spanning approximately one-third of the predetermined width of the top opening;

a divider portion between said first and said second trough portion for contiguously receiving and supporting a human user and having a divider length spanning the entire predetermined length of the top opening from one part of the predetermined width of the peripheral ridge to an opposed part of the predetermined width of the peripheral ridge and having a divider width spanning approximately one-third of the predetermined width of the top opening, said divider portion comprising seriatim a gradually sloping lower rest area and spanning horizontally on the order of about one-third the horizontal length of the predetermined length of the top opening for contiguously receiving and supporting the calves and feet of any sized user in an elevated posture, an intermediate rest area defined by a sloping intermediate rest area defined by a sloping intermediate surface smoothly merging with the lower rest area surface at a more acute angle with respect to a horizontal plane than the lower rest surface slopes with a horizontal plane and spanning on the order of about one-third the horizontal length of the predetermined length of the top opening for contiguously receiving and supporting the lower mid-section of any sized user, and a reclining rest area defined by a reclining surface merging with the sloping intermediate surface and sloping at a more acute angle with respect to a horizontal plane than the slopping intermediate surface, said reclining surface being at all points above said first and second trough bottoms and contiguously receiving and supporting the backs and shoulders of any sized user and terminating into a head rest area which interrupts the peripheral ridge and extends upwardly and outwardly relative to the peripheral ridge, said head rest area having a terminal end defining an arc with a transversely extending recess formed in the undersurface thereof.

2. The unitary suntanning pool of claim 1 additionally comprising a drink holder means formed in the side wall of said first trough portion.

3. The unitary suntanning pool of claim 2 wherein said drink holder comprises a generally rectangular platform for supporting a drink, said drink holder means protruding outwardly from said side wall into said first trough portion.

4. The unitary suntanning pool of claim 1 wherein the point of merger of said intermediate rest area with said reclining rest area is the lowest point of said divider portion with respect to said peripheral ridge and is above the bottom of said first and said second trough portion.

5. The unitary suntanning pool of claim 1 wherein said terminal end terminates in a terminal edge, said terminal edge is disposed outwardly from the peripheral ridge and lies in a horizontal plane that is common to a horizontal plane of the peripheral ridge.

6. The unitary suntanning pool of claim 1 wherein said lower rest area, that gradually slopes and smoothly merges with the intermediate rest area, commences the gradual sloping from the peripheral ridge.

* * * * *